US008522737B2

(12) United States Patent
Yokoyama et al.

(10) Patent No.: US 8,522,737 B2
(45) Date of Patent: Sep. 3, 2013

(54) VARIABLE VALVE TIMING MECHANISM WITH INTERMEDIATE LOCKING MECHANISM AND FABRICATION METHOD THEREOF

(75) Inventors: Yuu Yokoyama, Okazaki (JP); Masaki Numakura, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 70 days.

(21) Appl. No.: 13/258,785

(22) PCT Filed: Apr. 10, 2009

(86) PCT No.: PCT/JP2009/057387

§ 371 (c)(1), (2), (4) Date: Sep. 22, 2011

(87) PCT Pub. No.: WO2010/116532

PCT Pub. Date: Oct. 14, 2010

(65) Prior Publication Data

US 2012/0017858 A1 Jan. 26, 2012

(51) Int. Cl.
*F01L 1/34* (2006.01)

(52) U.S. Cl.
USPC ..... 123/90.17

(58) Field of Classification Search
USPC ..... 123/90.15, 90.17, 90.31
See application file for complete search history.

(56) References Cited

U.S. PATENT DOCUMENTS

| | | | | |
|---|---|---|---|---|
| 6,779,499 | B2 * | 8/2004 | Takenaka et al. | 123/90.17 |
| 2005/0016481 | A1 | 1/2005 | Komazawa et al. | |

FOREIGN PATENT DOCUMENTS

| | | |
|---|---|---|
| JP | 2002357105 | 12/2002 |
| JP | 2002357106 | 12/2002 |
| JP | 2003214123 | 7/2003 |
| JP | 2004084645 | 3/2004 |
| JP | 2004257313 | 9/2004 |
| JP | 2006170085 | 6/2006 |
| JP | 200924659 | 2/2009 |

OTHER PUBLICATIONS

English translation of International Preliminary Report on Patentability for PCT/JP2009/057387.

* cited by examiner

*Primary Examiner* — Zelalem Eshete
(74) *Attorney, Agent, or Firm* — Sughrue Mion, PLLC

(57) ABSTRACT

An intermediate lock mechanism is formed by first and second lock pins, an advancement restricting groove, and a retardation restricting groove. The first and second lock pins are arranged in a vane rotor 2 and projectable and retractable independently from each other. The advancement restricting groove is formed in a cover and becomes engaged with the first lock pin when the first lock pin is projected, thereby locking, at an intermediate lock phase, rotation of the vane rotor to the advancing side. The retardation restricting groove is formed in a cam sprocket and becomes engaged with the second lock pin when the second lock pin is projected, thereby locking, at the intermediate lock phase, rotation of the vane rotor to the retarding side. In this manner, reliable locking is ensured, and chattering of the vane rotor is easily prevented when locking is performed.

5 Claims, 8 Drawing Sheets

VARIABLE VALVE TIMING MECHANISM WITH INTERMEDIATE LOCKING MECHANISM AND FABRICATION METHOD THEREOF

CROSS-REFERENCE TO RELATED APPLICATION

This application is a 371 of PCT/JP2009/057387, filed Apr. 10, 2009; the disclosure of which is incorporated herein in its entirety.

FIELD OF THE INVENTION

The present invention relates to a variable valve timing mechanism with an intermediate lock mechanism and a method for manufacturing the variable valve timing mechanism.

BACKGROUND OF THE INVENTION

As is known in the art, a variable valve timing mechanism, which varies the valve timing of engine valves (intake/exhaust valves) by varying the rotational phase of the corresponding camshaft relative to the crankshaft, has been used as a mechanism in an internal combustion engine mounted in a vehicle. The variable valve timing mechanism includes a case that rotates synchronously with the crankshaft, which is the output shaft of the engine, and a vane rotor that has a coaxial axis, is accommodated in the case in a relatively rotatable manner, and rotates synchronously with a camshaft of the engine. Accommodation chambers are formed in the case and accommodate vanes of the vane rotor. Each of the accommodation chambers is divided by a corresponding one of the vanes into an advancing hydraulic pressure chamber and a retarding hydraulic pressure chamber. The advancing hydraulic pressure chambers and the retarding hydraulic pressure chambers are controlled to rotate the vane rotor relative to the case. In this manner, the rotational phase of the camshaft relative to the crankshaft is varied.

In many cases, a variable valve timing mechanism having the above-described configuration includes a lock mechanism for locking the rotational phase of the vane rotor at a prescribed phase at the time when the engine is started. The lock mechanism locks the rotational phase of the vane rotor by engaging a lock pin projecting from the vane rotor with a lock hole formed in the case.

In some variable valve timing mechanisms, the locked rotational phase of the vane rotor, which is brought about by the lock mechanism, is set to an intermediate lock phase, which is at the middle of the rotational range of the vane rotor. FIG. 6 shows a front cross section of a variable valve timing mechanism with an intermediate lock mechanism, which locks the rotational phase of a vane rotor at the intermediate lock phase. As shown in the drawing, the variable valve timing mechanism has a vane rotor 51 having three vanes 50 and a housing 53 including three accommodation chambers 52 for accommodating the vanes 50. The housing 53 is fastened to a cam sprocket 54 and a cover 55 (see FIG. 7), which covers the front side of the housing 53 as viewed in the drawing, in an integrally rotatable manner. The housing 53, the cam sprocket 54, and the cover 55 form a case for receiving the vane rotor 51.

With reference to FIG. 6, a lock pin 56 for the intermediate lock mechanism is arranged in one of the vanes 50 of the vane rotor 51. As illustrated in FIG. 7, which shows the cross section of the variable valve timing mechanism taken along curve VII-VII of FIG. 6, when the vane rotor 51 is in the intermediate lock phase, the phase of the lock pin 56 coincides with the phase of a lock hole 57 formed in the cam sprocket 54. In this state, as the lock pin 56 projects toward the cam sprocket 54, the lock pin 56 becomes engaged with the lock hole 57, thus locking rotation of the vane rotor 51.

However, for the reason described below, it is not easy to reliably lock the relative rotational phase of the vane rotor 51 at the intermediate lock phase. Specifically, in many variable valve timing mechanisms with an intermediate lock mechanism, in order to simplify a hydraulic system, a hydraulic circuit for controlling the phase of the vane rotor 51 and a hydraulic circuit for operating the lock pin 56 are not formed independently from each other. That is, as illustrated in FIG. 8(*a*), the lock pin 56 is operated when the vane rotor 51 is advanced (the vanes 50 are). In this case, immediately after the phases of the lock pin 56 and the lock hole 57 coincide with each other, the lock pin 56 is pressed against a wall surface of the lock hole 57 at the advancing side, thus causing friction. This may hamper engagement of the lock pin 56 with the lock hole 57. In other words, the lock pin 56 is allowed to become engaged with the lock hole 57 only at the instant when the phase of the lock pin 56 and the phase of the lock hole 57 coincide with each other.

The variable valve timing mechanism with an intermediate lock mechanism has the following problem. Specifically, immediately after the engine is started, the intermediate lock mechanism does not receive hydraulic pressure. Accordingly, if there is space between the lock pin 56 and the lock hole 57, variation in the cam torque cause the vane rotor 51 to chatter, generating rattling noise. To avoid this, it is necessary to prevent the gap from being formed between the lock pin 56 and the lock hole 57. However, this requires a significantly high level of machining accuracy.

Conventionally, a variable valve timing mechanism with an intermediate lock mechanism including two lock pins, as described in Patent Document 1, has been proposed. As illustrated in FIG. 9, the variable valve timing mechanism has a vane rotor 61 having a plurality of (in the drawing, two) vanes 60, which project from the outer periphery of the vane rotor 61, and a housing 63 in which a plurality of accommodation chambers 62 are formed (in the drawing, two) to receive the vanes 60. The housing 63 of the variable valve timing mechanism has two lock pins 64, 65, which are spaced apart by a prescribed phase and capable of projecting toward the vane rotor 61. A lock groove 66, with which the two lock pins 64, 65 are engageable simultaneously, is formed in the outer periphery of the vane rotor 61.

FIGS. 10(*a*) to 10(*c*) illustrate the operating steps of the intermediate lock mechanism for the variable valve timing mechanism including the above-described two pins 64, 65. When the vane rotor 61 is rotated clockwise as viewed in the drawings with the lock pins 64, 65 disengaged from the lock groove 66, the lock pin 64 is first received in the lock groove 66 as illustrated in FIG. 10(*a*). As the vane rotor 61 is rotated counterclockwise continuously from the state of FIG. 10(*a*), the phase of the lock pin 65 coincides with the counterclockwise end of the lock groove 66 as viewed in the drawings and thus becomes engageable with the lock groove 66, referring to FIG. 10(*b*). In this state, the lock pin 64, which is engaged, is pressed against the clockwise end of the lock groove 66 as viewed in the drawing. However, the lock pin 65, which is not engaged, is maintained free. This allows the lock pin 65 to be smoothly received in the lock groove 66, as illustrated in FIG. 10(*c*). The vane rotor 61 is thus locked from rotating relative to the housing 63.

Since the variable valve timing mechanism includes the two lock pins 64, 65, as has been described, rotation of the vane rotor 51 is easily locked at the intermediate lock phase. However, in order to prevent chattering of the vane rotor 51 from occurring when the vane rotor 51 is locked in a state without hydraulic pressure, the lock groove 66 must be machined with significantly high accuracy, as in the case of the variable valve timing mechanism having the single lock pin 56.

Patent Document 1: Japanese Laid-Open Patent Publication No. 2006-170085

SUMMARY OF THE INVENTION

Accordingly, it is an objective of the present invention to provide a variable valve timing mechanism with an intermediate lock mechanism that ensures reliable locking and easily prevents chattering of a vane rotor when the vane rotor is locked.

To achieve the foregoing objective, the present invention provides a variable valve timing mechanism with an intermediate lock mechanism that varies a rotational phase of a camshaft relative to a crankshaft between a most advanced phase and a most retarded phase, and includes a first rotary body, a second rotary body, and an intermediate lock mechanism. The first rotary body rotates synchronously with one of the crankshaft and the camshaft. The second rotary body rotates synchronously with the other one of the crankshaft and the camshaft, has a coaxial axis with the first rotary body, and accommodates the first rotary body in a relatively rotatable manner. The second rotary body is formed by fastening a first member and a second member to each other. The intermediate lock mechanism locks rotation of the first rotary body relative to the second rotary body at an intermediate lock phase between the most advanced phase and the most retarded phase. The intermediate lock mechanism includes a first lock pin and a second lock pin, an advancement restricting grove, and a retardation restricting groove. The first lock pin and a second lock pin are arranged in the first rotary body, and are projectable and retractable independently from each other. The advancement restricting groove is arranged in the first member, and is formed in such a manner as to, when the first lock pin is projected, become engaged with the first lock pin to lock, at the intermediate lock phase, rotation of the first rotary body to an advancing side, and permit, at the intermediate lock phase, rotation of the first rotary body to a retarding side. The retardation restricting groove is arranged in the second member, and is formed in such a manner as to, when the second lock pin is projected, become engaged with the second lock pin to lock, at the intermediate lock phase, rotation of the first rotary body to the retarding side, and permit, at the intermediate lock phase, rotation of the first rotary body to the advancing side.

The variable valve timing mechanism with an intermediate lock mechanism, which is configured as described above, varies the rotational phase of the camshaft relative to the crankshaft between the most advanced phase and the most retarded phase through relative rotation between the first and second rotary bodies. Rotation of the first rotary body from the intermediate lock phase to the advancing side is locked through engagement between the first lock pin and the advancement restricting groove. Rotation of the first rotary body from the intermediate lock phase to the retarding side is locked through engagement between the second lock pin and the retardation restricting groove. In this manner, rotation of the first rotary body relative to the second rotary body is locked at the intermediate lock phase. The variable valve timing mechanism with an intermediate lock mechanism thus allows the first and second lock pins to enter the corresponding advancement/retardation restricting grooves in a free state without being pressed from the side. As a result, reliable locking by the intermediate lock mechanism is ensured.

Also in the above-described configuration, the advancement restricting groove and the retardation restricting groove are formed in the separate members. In this configuration, with the first lock pin held in contact with the end of the advancement restricting groove at the advancing side and the second lock pin held in contact with the end of the retardation restricting groove at the retarding side, the first member and the second member are fastened to each other. In this manner, even if there is some degree of dimensional tolerance, the lock pins and the corresponding restricting grooves are arranged in such a manner as to prevent chattering between the lock pins and the restricting grooves when locking is performed. As a result, the above-described configuration not only ensures reliable locking, but also easily prevents chattering of a vane rotor when locking is carried out.

As needed, ratchet grooves having a comparatively small depth may be each formed continuously from the corresponding one of the advancement restricting groove and the retardation restricting groove in the variable valve timing mechanism with an intermediate lock mechanism. In this case, when locking is not performed, the ratchet grooves and the lock pins function as a ratchet mechanism and thus guide the first rotary body to the intermediate lock phase.

The above described variable valve timing mechanism with an intermediate lock mechanism may be configured such that one of the first and second members is a cam sprocket and the other is a cover that is formed to cover a front surface of the cam sprocket.

On the other hand, to achieve the foregoing objective, the present invention provides a method for manufacturing a variable valve timing mechanism with an intermediate lock mechanism. The variable valve timing mechanism varies a rotational phase of a camshaft relative to a crankshaft between a most advanced phase and a most retarded phase, and includes a first rotary body, a second rotary body, and an intermediate lock mechanism. The first rotary body rotates synchronously with one of the crankshaft and the camshaft. The second rotary body rotates synchronously with the other one of the crankshaft and the camshaft, has a coaxial axis with the first rotary body, and accommodates the first rotary body in a relatively rotatable manner. The second rotary body is formed by fastening a first member and a second member to each other. The intermediate lock mechanism locks rotation of the first rotary body relative to the second rotary body at an intermediate lock phase between the most advanced phase and the most retarded phase. The method for manufacturing a variable valve timing mechanism with an intermediate lock mechanism includes: assembling a first lock pin and a second lock pin to the first rotary body; forming an advancement restricting groove in the first member, the advancement restricting groove becoming engaged with the first lock pin to lock, at the intermediate lock phase, rotation of the first rotary body to an advancing side and permit, at the intermediate lock phase, rotation of the first rotary body to a retarding side; forming a retardation restricting groove in the second member, the retardation restricting groove becoming engaged with the second lock pin to lock, at the intermediate lock phase, rotation of the first rotary body to the retarding side and permit, at the intermediate lock phase, rotation of the first rotary body to the advancing side; and fastening the first member and the second member to each other with the first lock pin held in contact with an end of the advancement restricting groove at the advancing side and the second lock pin held in contact with an end of the retardation restricting groove at the retarding side.

According to the above-described manufacturing method, the first member and the second member are fastened together with the first lock pin held in contact with the end of the advancement restricting groove at the advancing side and the second lock pin held in contact with the end of the retardation restricting groove at the retarding side. In this manner, even if there is some degree of dimensional tolerance, the lock pins and the corresponding restricting grooves are arranged in such a manner as to prevent chattering between the lock pins and the restricting grooves when locking is performed. Further, in the method, rotation of the first rotary body from the intermediate lock phase to the advancing side is locked through engagement between the first lock pin and the advancement restricting groove. Rotation of the first rotary body from the intermediate lock phase to the retarding side is locked through engagement between the second lock pin and the retardation restricting groove. In this manner, rotation of the first rotary body relative to the second rotary body is locked at the intermediate lock phase. The variable valve timing mechanism with an intermediate lock mechanism thus allows the first and second lock pins to enter the corresponding advancement/retardation restricting grooves in a free state without being pressed from the side. As a result, reliable locking by the intermediate lock mechanism is ensured. The above-described manufacturing method thus not only ensures the reliable locking, but also easily prevents chattering of the vane rotor when locking is performed.

In the above-describe method, ratchet grooves having a comparatively small depth may be each formed continuously from the corresponding one of the advancement restricting groove and the retardation restricting groove. In this case, when locking is not performed, the ratchet grooves and the lock pins function as a ratchet mechanism and thus guide the first rotary body to the intermediate lock phase.

DETAILED DESCRIPTION OF THE PREFERRED EMBODIMENTS

One embodiment of a variable valve timing mechanism with an intermediate lock mechanism and a method for manufacturing the variable valve timing mechanism according to the present invention will now be described in detail with reference to FIGS. 1 to 5.

Figure 1:
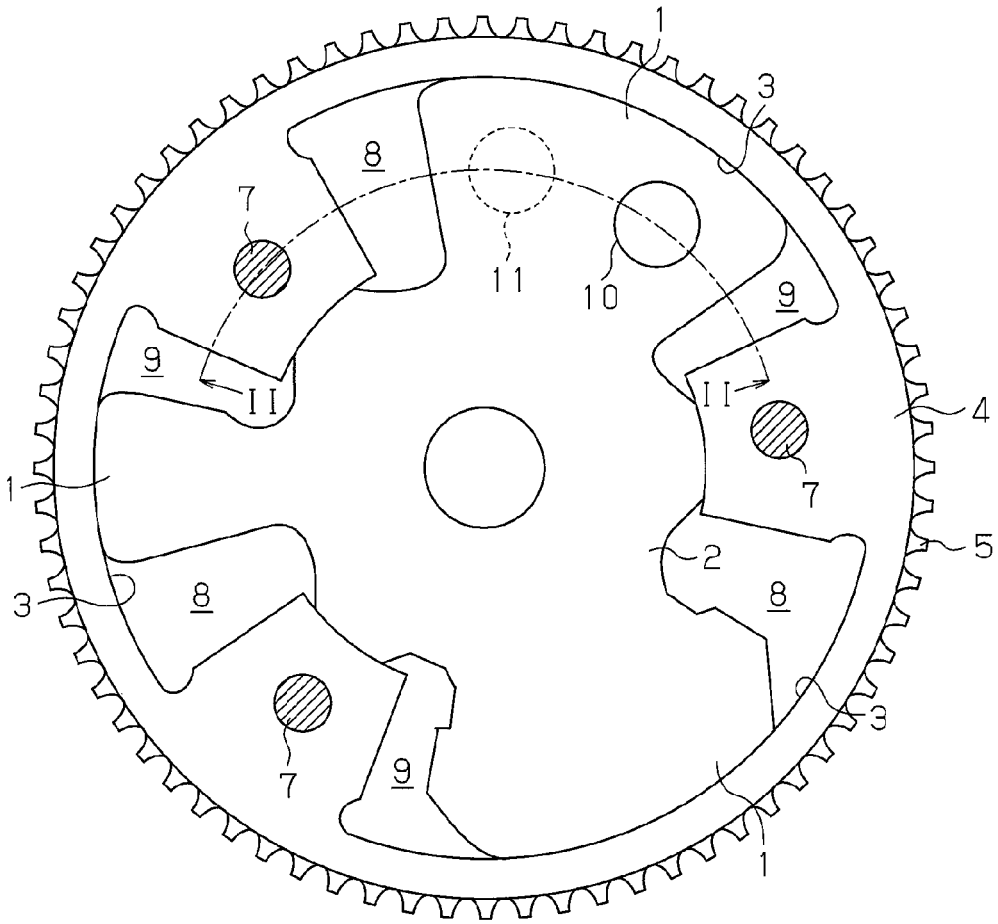
FIG. 1 is a front cross-sectional view showing a variable valve timing mechanism with an intermediate lock mechanism according to one embodiment of the present invention.

FIG. 1 shows a front cross section of the variable valve timing mechanism with an intermediate lock mechanism of the illustrated embodiment. As shown in FIG. 1, the variable valve timing mechanism with an intermediate lock mechanism has a vane rotor 2 including a plurality of (in the drawing, three) vanes 1, which project from the outer periphery of the vane rotor 2, and a housing 4 in which a plurality of (in the drawing, three) accommodation chambers 3 are formed to accommodate the corresponding vanes 1. The vane rotor 2, which serves as a first rotary body, is connected to a camshaft of an internal combustion engine in an integrally rotatable manner. The housing 4 is fastened to a cam sprocket 5, which is drivably connected to the crankshaft, or the engine output shaft, through a timing chain in a synchronously rotatable manner, and a cover 6 (shown in not FIG. 1 but FIG. 2) for covering a front surface of the housing 4 by means of a plurality of bolts 7. In the present embodiment, the housing 4, the cam sprocket 5, and the cover 6, which are fastened together as an integral body, configure a vane rotor accommodating case serving as a second rotary body.

Each of the accommodation chambers 3 in the housing 4 is divided into an advancing hydraulic pressure chamber 8 and a retarding hydraulic pressure chamber 9 by a corresponding one of the vanes 1, which are accommodated in the accommodation chambers 3. The variable valve timing mechanism with an intermediate lock mechanism controls the hydraulic pressure in the advancing hydraulic pressure chamber 8 and the hydraulic pressure in the retarding hydraulic pressure chamber 9 to rotate the vane rotor 2 relative to the aforementioned case. This varies the rotational phase of the corresponding camshaft relative to the crankshaft and thus the valve timing of the engine valves that are opened or closed by the cam formed in the camshaft.

The variable valve timing mechanism has the intermediate lock mechanism for locking rotation of the vane rotor 2 relative to the case (the housing 4, the cam sprocket 5, and the cover 6) at the intermediate lock phase, which is set between the most advanced phase and the most retarded phase of the vane rotor 2. The intermediate lock mechanism has two lock pins formed in one of the vanes 1 of the vane rotor 2, which are a first lock pin 10 and a second lock pin 11.

Figure 2:
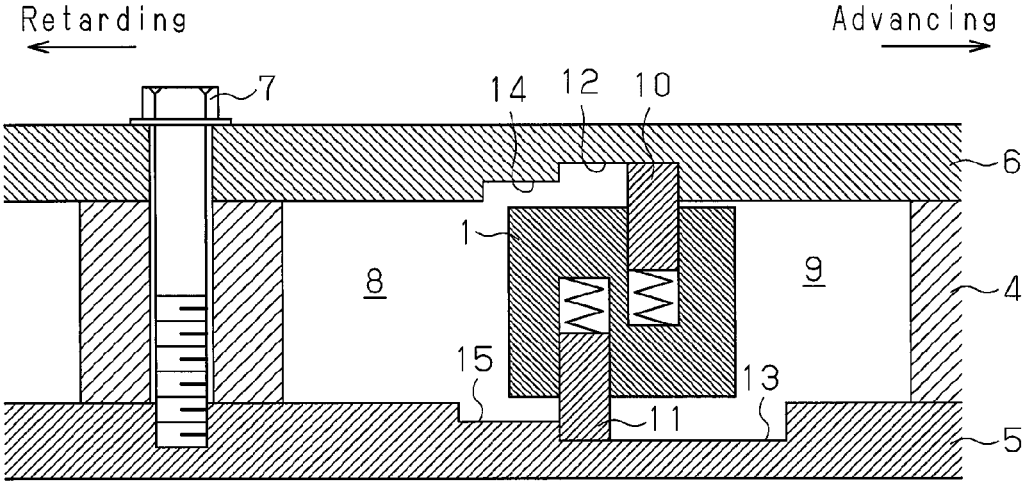
FIG. 2 is a cross-sectional view taken along curve II-II in FIG. 1, showing the variable valve timing mechanism with an intermediate lock mechanism.

FIG. 2 shows a cross section taken along curve II-II in FIG. 1, showing the variable valve timing mechanism in the vicinity of the first and second lock pins 10, 11. With reference to FIG. 2, the first lock pin 10 is capable of projecting toward the cover 6, and the second lock pin 11 is capable of projecting toward the cam sprocket 5. The surface of the cover 6 facing the first lock pin 10 has an advancement restricting groove 12, which becomes engaged with the first lock pin 10 when the first lock pin 10 is projected, thus locking rotation of the vane rotor 2 to the advancing side at the intermediate lock phase and permitting rotation of the vane rotor 2 to the retarding side in the intermediate lock phase. The surface of the cam sprocket 5 facing the second lock pin 11 has a retardation restricting groove 13, which becomes engaged with the second lock pin 11 when the second lock pin 11 is projected, thus locking rotation of the vane rotor 2 to the retarding side at the intermediate lock phase and permitting rotation of the vane rotor 2 to the advancing side in the intermediate lock phase.

When the first lock pin 10 is in the advancement restricting groove 12, relative rotation of the vane rotor 2 to the advancing side is locked at the intermediate lock position. When the second lock pin 11 is in the retardation restricting groove 13, relative rotation of the vane rotor 2 to the retarding side is locked at the intermediate lock position. Accordingly, when the first lock pin 10 and the second lock pin 11 are received in the advancement restricting groove 12 and the retardation restricting groove 13, respectively, the relative rotation of the vane rotor 2 is locked at the intermediate lock phase. In the present embodiment, the cover 6 having the advancement restricting groove 12 corresponds to the first member and the cam sprocket 5 having the retardation restricting groove 13 corresponds to the second member.

In the variable valve timing mechanism of the illustrated embodiment, ratchet grooves 14, 15, which are smaller in depth than the advancement restricting groove 12 and the retardation restricting groove 13, are formed continuously from the corresponding restricting grooves 12, 13 at the retardation sides. The ratchet grooves 14, 15 function as a ratchet mechanism together with the first and second lock pins 10, 11. In this manner, when the engine is started with operation of the intermediate lock mechanism suspended, the first and second lock pins 10, 11 are guided to the advancement restricting groove 12 and the retardation restricting groove 13. This facilitates operation of the intermediate lock mechanism.

Specifically, if engine start is initiated when the first lock pin 10 and the second lock pin 11 are disengaged from the advancement restricting groove 12 and the retardation restricting groove 13, respectively, and the relative rotation of the vane rotor 2 is not locked at the intermediate lock phase, the variable valve timing mechanism with an intermediate lock mechanism operates in the following manner. That is, when cranking is carried out to initiate the engine start, the camshaft generates alternating torque acting alternately to the advancing side and the retarding side. The alternating torque rotates the vane rotor 2, the phase of which is unfixed, alternately to the advancing side and the retarding side with respect to the vane rotor accommodating case. When the torque to the advancing side is produced, the vane rotor 2 is rotated to the advancing side, thus causing the first lock pin 10 to enter the ratchet groove 14. When the torque to the advancing side is generated for a second time, the vane rotor 2 is rotated to the advancing side from the phase in which the first lock pin 10 is received in the ratchet groove 14. This allows the second lock pin 11 to enter the ratchet groove 15. When a subsequent advancing torque is generated, the vane rotor 2 is rotated to the advancing side from the phase in which the second lock pin 11 is received in the ratchet groove 15, thus allowing the first lock pin 10 to be received in the advancement restricting groove 12. When a subsequent advancing torque is produced, the vane rotor 2 is rotated to the advancing side from the phase in which the first lock pin 11 is received in the advancement restricting groove 12. The second lock pin 11 is thus received in the retardation restricting groove 13. As has been described, each time the torque to the advancing side is generated, the vane rotor 2 is rotated closer to the intermediate lock phase in a stepped manner. As a result, the ratchet grooves 14, 15 allow the intermediate lock mechanism to operate through autonomous restoration when the intermediate lock mechanism is unlocked.

Operation of the intermediate lock mechanism will hereafter be described. Specifically, the following description is focused on a case in which the intermediate lock mechanism is operated as the vane rotor 2 is relatively rotated toward the advancing side from the most retarded phase.

Figure 3A:
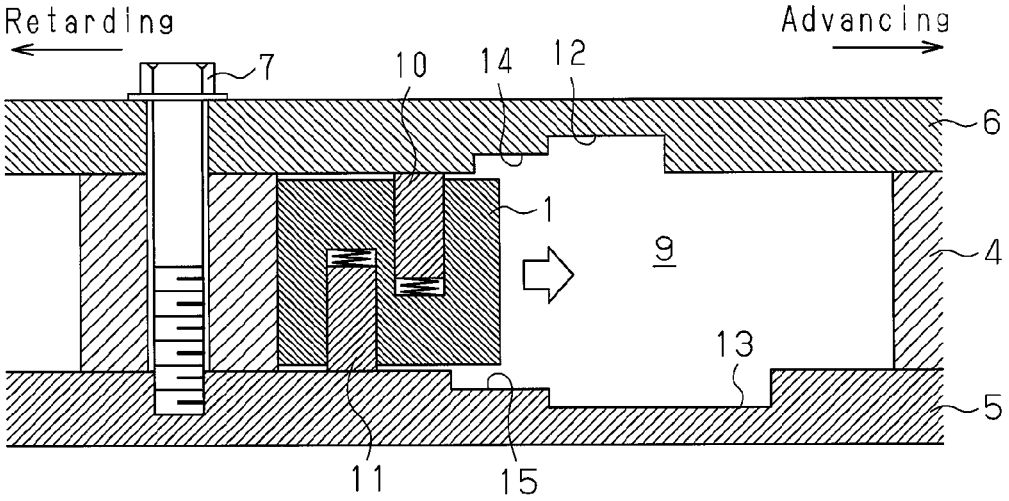
FIGS. 3(*a*), 3(*b*), and 3(*c*) are cross-sectional views each illustrating an operating step of the intermediate lock mechanism of the illustrated embodiment.
Figure 3B:
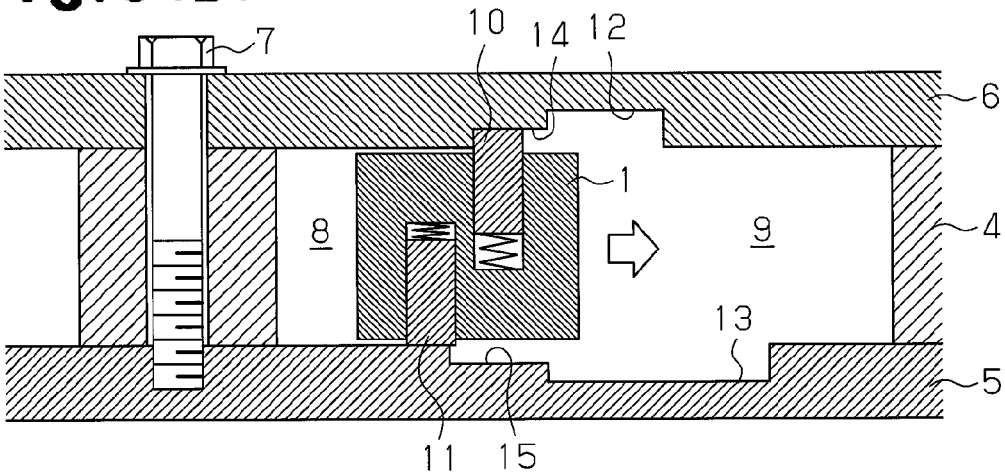
Figure 3C:
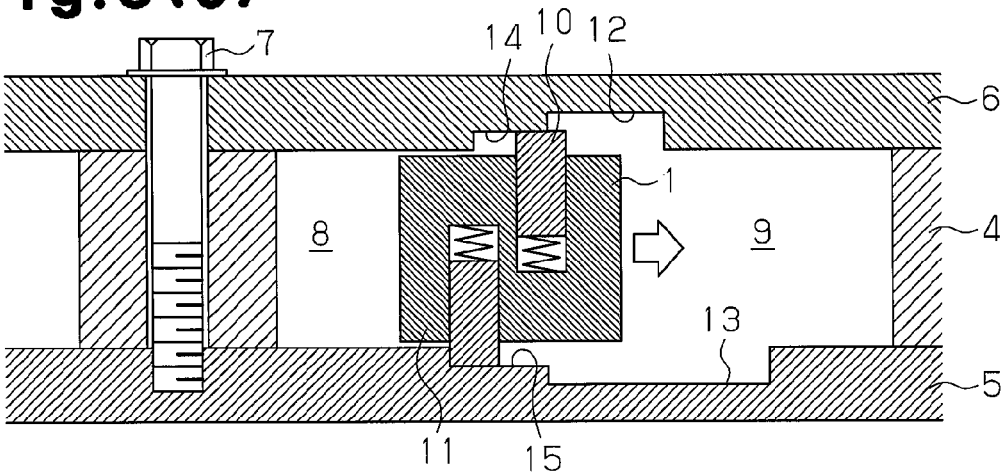

As the vane rotor 2 is relatively rotated toward the advancing side from the state in which each vane 1 is at the most retarded phase as illustrated in FIG. 3(*a*), the first lock pin 10 is received in the ratchet groove 14 in the cover 6, referring to FIG. 3(*b*). Then, as illustrated in FIG. 3(*c*), the second lock pin 11 is received in the ratchet groove 15 in the cam sprocket 5.

Figure 4D:
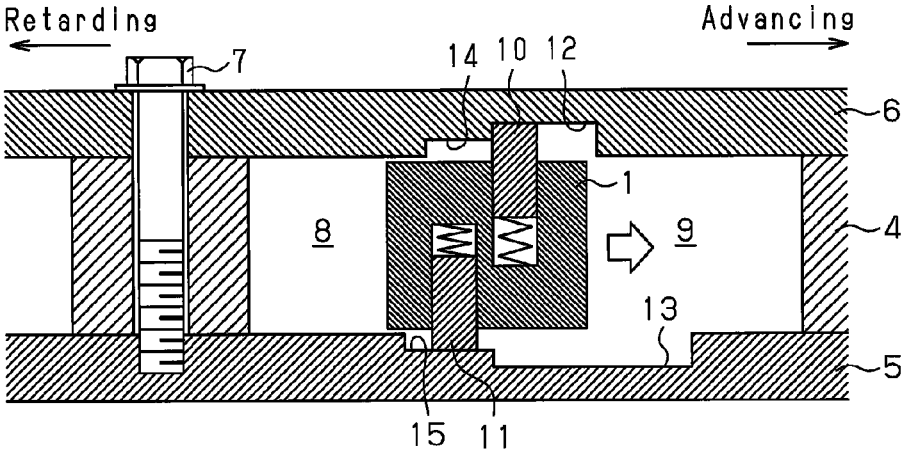
FIGS. 4(*d*), 4(*e*), and 4(*f*) are cross-sectional views each illustrating an operating step of the intermediate lock mechanism of the illustrated embodiment.
Figure 4E:
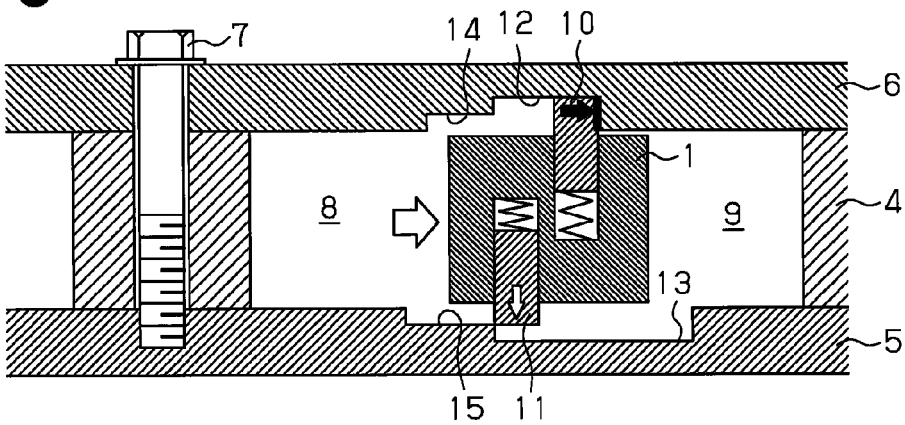
Figure 4F:
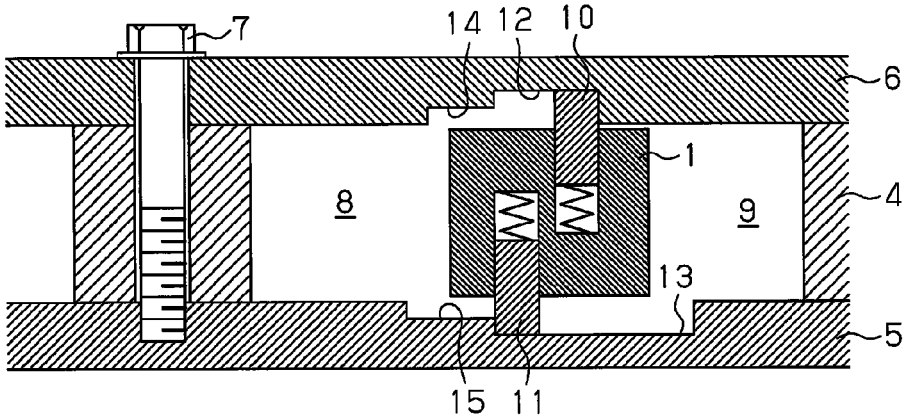

Afterwards, as the vane rotor 2 is relatively rotated further toward the advancing side, the first lock pin 10 enters the advancement restricting groove 12, with reference to FIG. 4(*d*). Relative rotation of the vane rotor 2 toward the advancing side is continued until the first lock pin 10 reaches the end of the advancement restricting groove 12 at the advancing side. Then, as illustrated in FIG. 4(*e*), the phase of the second lock pin 11 coincides with the phase of the end of the retardation restricting groove 13 at the retarding side. The second lock pin 11 thus becomes engageable with the retardation restricting groove 13. In this state, the first lock pin 10 is pressed against the end of the advancement restricting groove 12 at the advancing side, but the second lock pin 11 is held free without being pressed sideways. This allows the second lock pin 11 to be received smoothly in the retardation restricting groove 13, as illustrated in FIG. 4(*f*). As a result, the vane rotor 2 is locked at the intermediate lock phase by the intermediate lock mechanism.

Next, a method for manufacturing the variable valve timing mechanism with an intermediate lock mechanism will be described.

Figure 5A:
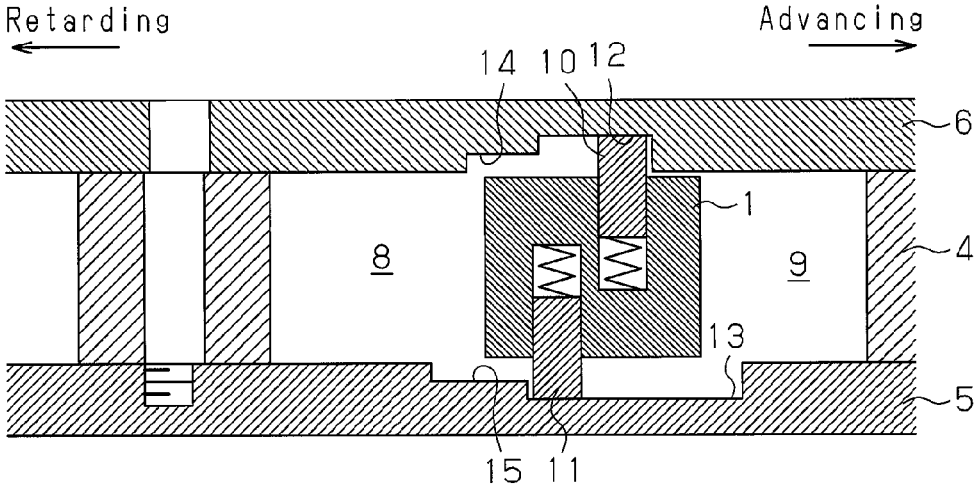
FIGS. 5(*a*), 5(*b*), and 5(*c*) are cross-sectional views each illustrating a manufacturing step of the intermediate lock mechanism of the illustrated embodiment.
Figure 5B:
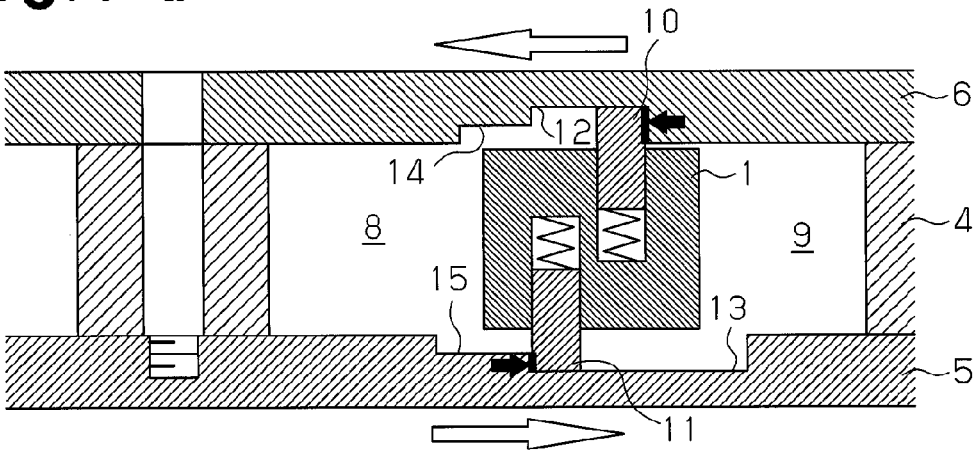
Figure 5C:
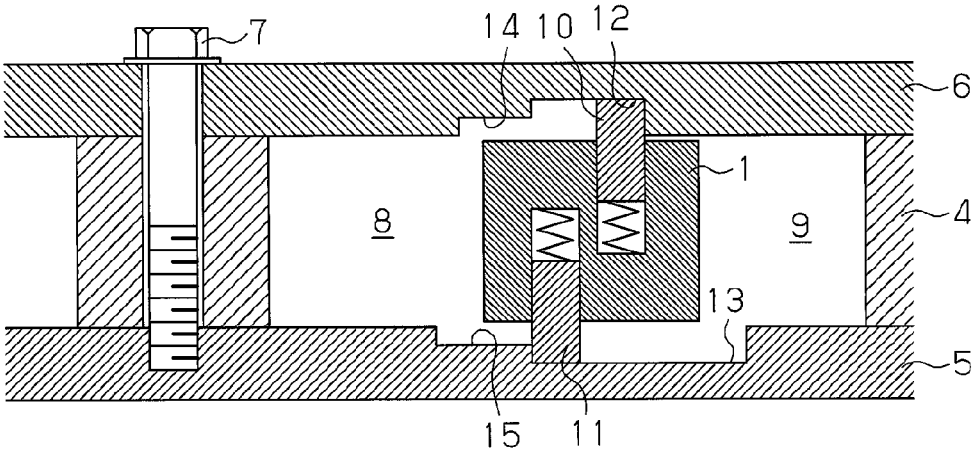
Figure 6:
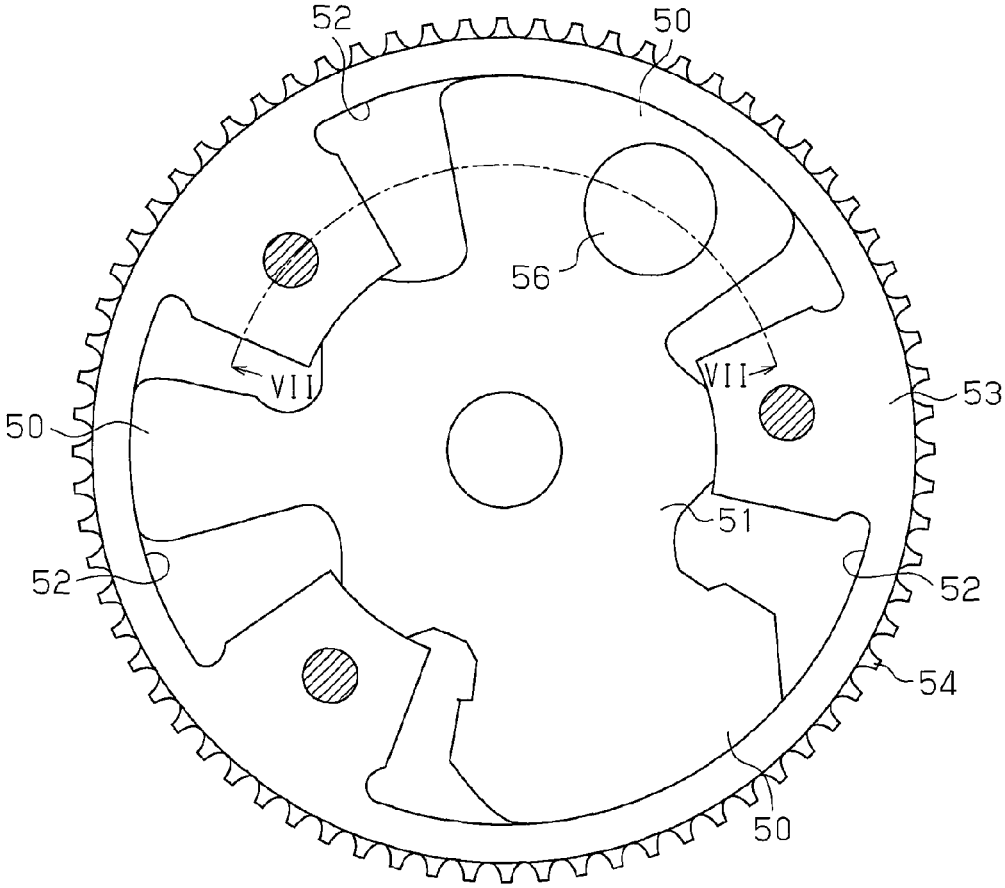
Fig.6(Prior Art)
FIG. 6 is a front cross-sectional view showing a conventional example of a variable valve timing mechanism with an intermediate lock mechanism.
Figure 7:
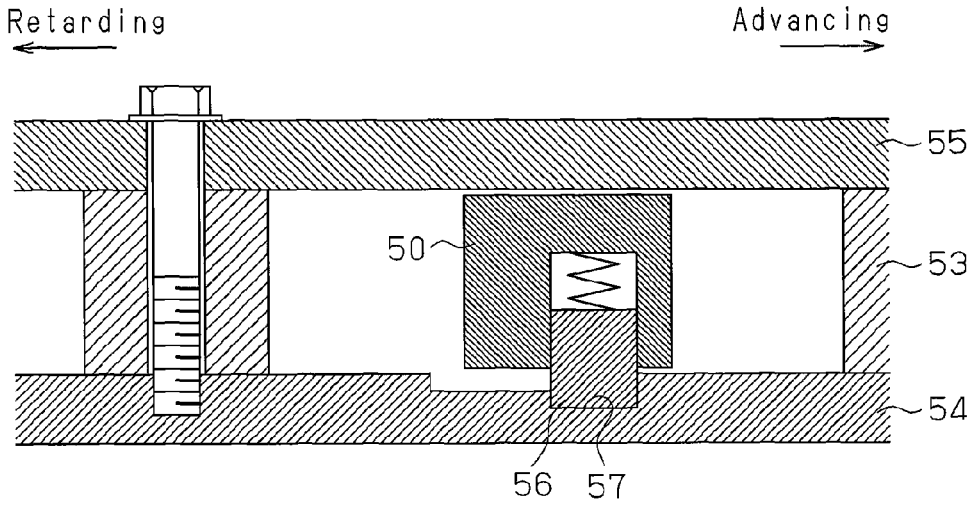
Fig.7(Prior Art)
FIG. 7 is a cross-sectional view taken along curve VII-VII in FIG. 6, showing the variable valve timing mechanism with an intermediate lock mechanism.
Figure 8A:
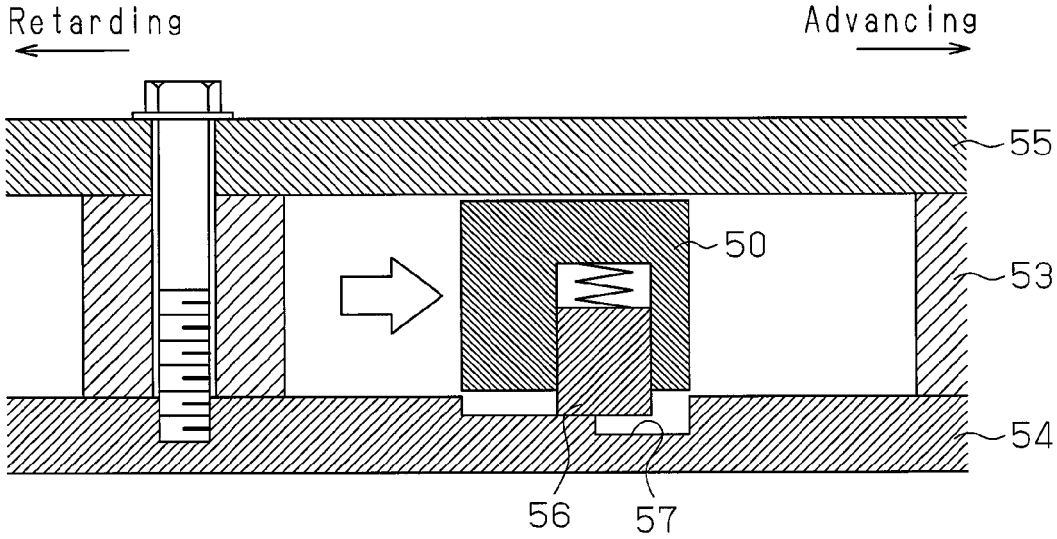
Fig.8(a)(Prior Art)
FIGS. 8(*a*) and 8(*b*) are cross-sectional views each illustrating an operating step of the intermediate lock mechanism of the conventional variable valve timing mechanism with an intermediate lock mechanism.
Figure 8B:
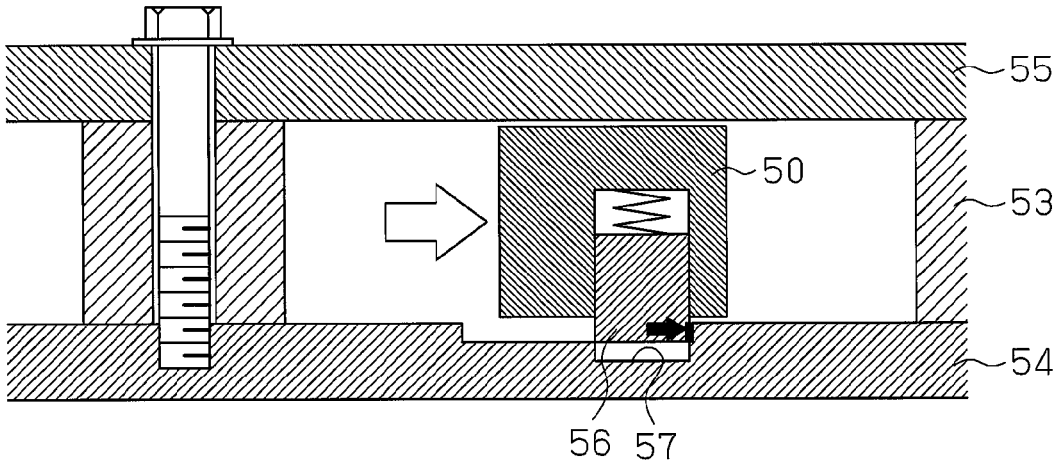
Fig.8(b)(Prior Art)
Figure 9:
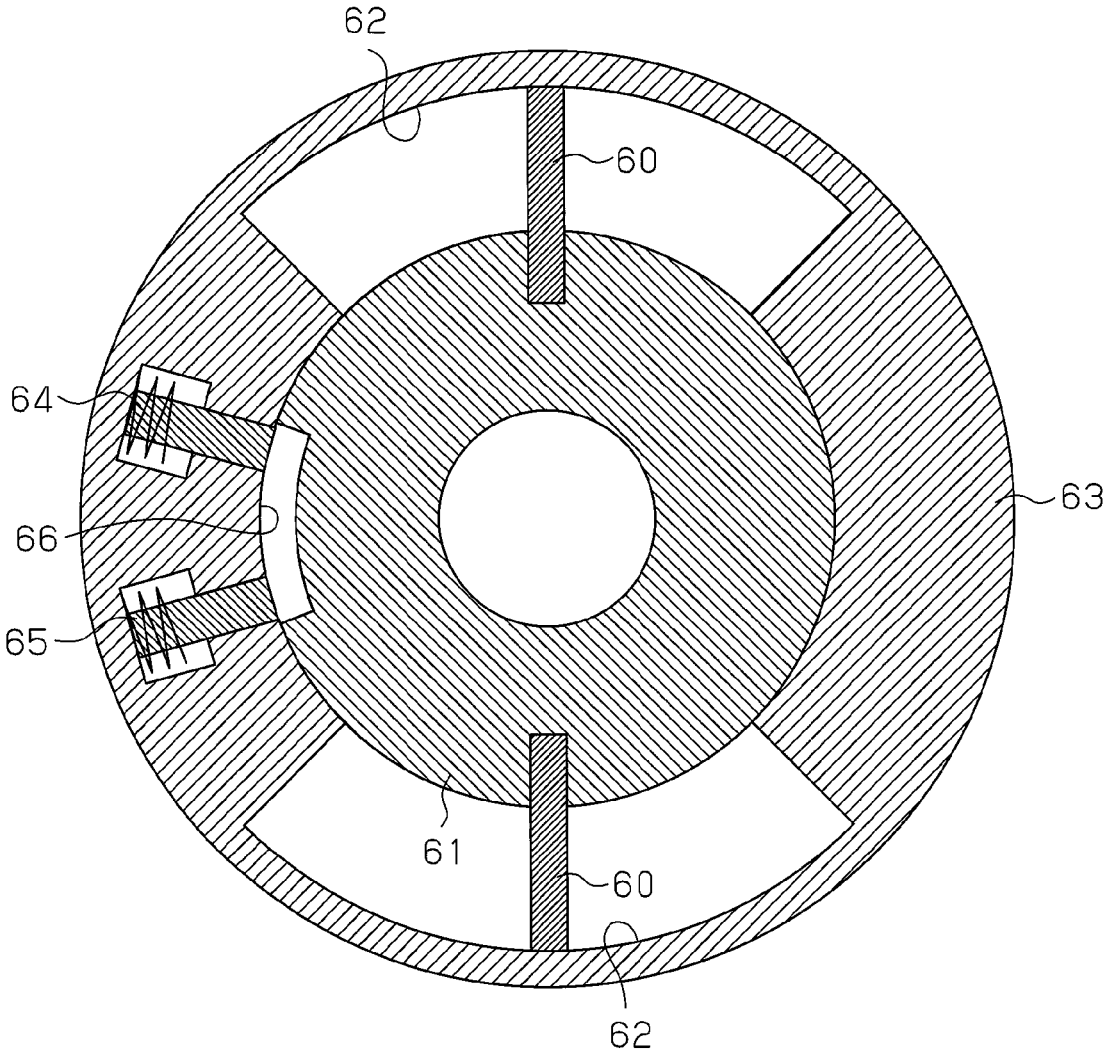
Fig.9(Prior Art)
FIG. 9 is a front cross-sectional view showing another conventional example of a variable valve timing mechanism with an intermediate lock mechanism.
Figure 10A:
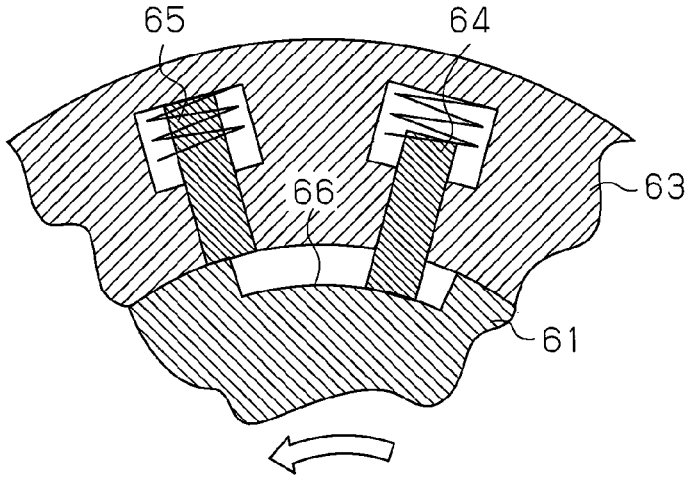
Fig.10(a)(Prior Art)
FIGS. 10(*a*), 10(*b*), and 10(*c*) are cross-sectional views each illustrating an operating step of the intermediate lock mechanism of the conventional variable valve timing mechanism with an intermediate lock mechanism.
Figure 10B:
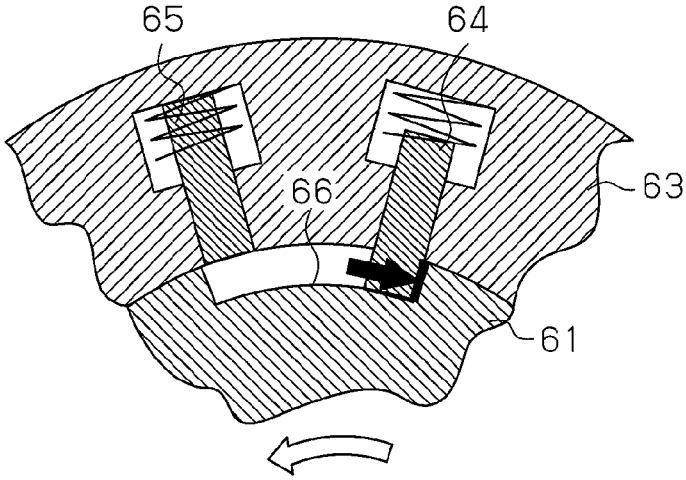
Fig.10(b)(Prior Art)
Figure 10C:
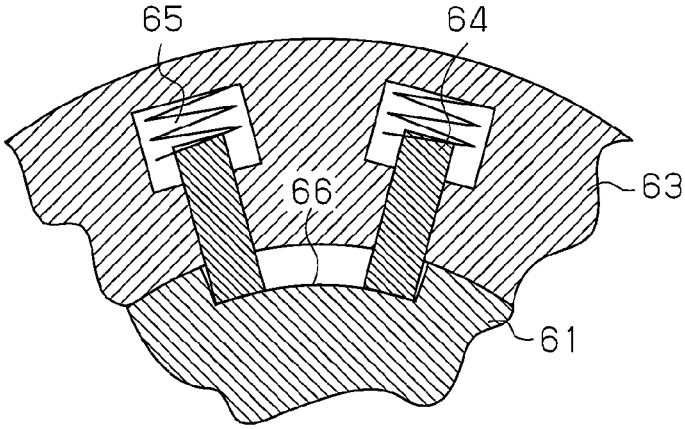
Fig.10(c)(Prior Art)

To manufacture the variable valve timing mechanism, the first and second lock pins 10, 11 are assembled to the vane rotor 2. Further, the retardation restricting groove 13 and the advancement restricting groove 12 are formed in the cam sprocket 5 and the cover 6, respectively. Afterwards, as illustrated in FIG. 5(*a*), with the vane rotor 2 accommodated, the housing 4, the cam sprocket 5, and the cover 6 are assembled temporarily without fastening a bolt 7. At this stage, even though the first and second lock pins 10, 11 are received in the advancement/retardation restricting grooves 12, 13, a clearance is ensured between each pin and the corresponding restricting groove. As a result, the phase of the vane rotor 2 (each vane 1) is not fully fixed.

Subsequently, as illustrated in FIG. 5(*b*), the first lock pin 10 is brought into contact with the end of the advancement restricting groove 12 at the advancing side, and the second lock pin 11 is brought into contact with the end of the retardation restricting groove 13 at the retarding side. In this manner, the clearances are canceled with respect to the restricting grooves. Then, in this state, with reference to FIG. 5(*c*), the bolt 7 is fastened to fix the housing 4, the cam sprocket 5, and the cover 6 together as an integral body.

The variable valve timing mechanism with an intermediate lock mechanism of the present embodiment has the advantages described below.

(1) In the present embodiment, the intermediate lock mechanism of the variable valve timing mechanism includes the first and second lock pins 10, 11 and the advancement/retardation restricting grooves 12, 13 that are configured as will be described. Specifically, the first and second lock pins 10, 11, which are projectable and retractable independently from each other, are formed in the vane rotor 2. The cover 6 includes the advancement restricting groove 12, which becomes engaged with the first lock pin 10 when the first lock pin 10 is projected, thus locking rotation of the vane rotor 2 to the advancing side at the intermediate lock phase and permitting rotation of the vane rotor 1 to the retarding side at the intermediate lock phase. The cam sprocket 5 has the retardation restricting groove 13, which becomes engaged with the second lock pin 11 when the second lock pin 11 is projected, thus locking rotation of the vane rotor 2 to the retarding side at the intermediate lock phase and permitting rotation of the vane rotor 2 to the advancing side at the intermediate lock phase. In the variable valve timing mechanism with an intermediate lock mechanism configured as described above, the first lock pin 10 is engaged with the advancement restricting groove 12 to lock the rotation of the vane rotor 2 from the intermediate lock phase to the advancing side. Also, the second lock pin 11 is engaged with the retardation restricting groove 13 to lock the rotation of the vane rotor 2 from the intermediate lock phase to the retarding side. As a result, the rotation of the vane rotor 2 relative to the case (the housing 4, the cam sprocket 5, and the cover 6) is locked at the intermediate lock phase. In this variable valve timing mechanism with an intermediate lock mechanism, the first and second lock pins 10, 11 are received in the corresponding advancement/retardation restricting grooves 12, 13 each in a free state without being pressed from the side. This ensures reliable locking by the intermediate lock mechanism. Further, in the present embodiment, the advancement restricting groove 12 and the retardation restricting groove 13 are formed in the separate members. In this arrangement, the cam sprocket 5 and the cover 6 are fastened together with the first lock pin 10 held in contact with the end of the advancement restricting groove 12 at the advancing side and the second lock pin 10 held in contact with the end of the retardation restricting groove 13 at the retarding side. In this manner, even if there is a some degree of dimensional tolerance, the lock pins and the relative grooves are arranged without causing chattering between the lock pins and the corresponding restricting grooves at the time when locking is performed. As a result, the above-described configuration not only ensures reliable locking, but also easily prevents chattering of the vane rotor when the vane rotor is locked.

(2) According to the manufacturing method of the present embodiment, the variable valve timing mechanism with an intermediate lock mechanism is manufactured through the steps of:

assembling the first and second lock pins 10, 11 to the vane rotor 2;

forming, in the cover 6, the advancement restricting groove 12, which becomes engaged with the first lock pin 10 to lock rotation of the vane rotor 2 to the advancing side at the intermediate lock phase and permit rotation of the vane rotor 2 to the retarding side at the intermediate lock phase;

forming, in the cam sprocket, the retardation restricting groove 13, which becomes engaged with the second lock pin 11 to lock the rotation of the vane rotor 2 to the retarding side at the intermediate lock phase and permit the rotation of the vane rotor 2 to the advancing side at the intermediate lock phase; and fastening the cover 6 and the cam sprocket 5 to each other with the first lock pin 10 held in contact with the end of the advancement restricting groove 12 at the advancing side and the second lock pin 11 held in contact with the end of the retardation restricting groove 13 at the retarding side.

This manufacturing method allows arrangement of the lock pins and the corresponding restricting grooves without causing chattering between the lock pins and the restricting grooves at the time when locking is performed, even if there is some degree of dimensional tolerance. Further, in the manufacturing method, the first lock pin 10 is engaged with the advancement restricting groove 12 to lock the rotation of the vane rotor 2 from the intermediate lock phase to the advancing side. The second lock pin 11 is engaged with the retardation restricting groove 13 to lock the rotation of the vane rotor 2 from the intermediate lock phase to the retarding side. In this manner, rotation of the vane rotor 2 relative to the case (the housing 4, the cam sprocket 5, and the cover 6) is locked at the intermediate lock phase. The variable valve timing mechanism with an intermediate lock mechanism allows the first and second lock pins 10, 11 to enter the corresponding advancement/retardation restricting grooves 12, 13 in a free state without being pressed from the side. The intermediate lock mechanism thus ensures reliable locking. This not only ensures the reliable locking, but also easily prevents chattering of the vane rotor when locking is performed.

(3) In the present embodiment, the ratchet grooves 14, 15, which are comparatively small in depth, are formed continuously from the corresponding advancement/retardation restricting grooves 12, 13 in the variable valve timing mechanism with an intermediate lock mechanism. Accordingly, when locking is not performed, the ratchet grooves 14, 15 and the first and second lock pins 10, 11 function as a ratchet mechanism and thus guide the vane rotor 2 to the intermediate lock phase.

The above-described embodiment may be modified according to the forms described below.

In the above-described embodiment, the advancement restricting groove 12 is formed in the cover 6, and the retardation restricting groove 13 is formed in the cam sprocket 5. However, the advancement restricting groove 12 may be formed in the cam sprocket 5, and the retardation restricting groove 13 may be formed in the cover 6.

In the above-described embodiment, the second rotary body is configured by three members, which are the housing 4, the cam sprocket 5, and the cover 6. However, the second rotary body may be configured by two separate members or four or more separate members. Also in these cases, the same advantages as the advantages of the above-described embodiment are ensured as long as the advancement restricting groove 12 and the retardation restricting groove 13 are formed in separate members.

In the above-described embodiment, the ratchet grooves 14, 15, which have a comparatively small depth, are formed continuously from the corresponding advancement/retardation restricting grooves 12, 13. However, even without the ratchet grooves 14, 15, reliable locking by the intermediate lock mechanism may be ensured.

The invention claimed is:

1. A variable valve timing mechanism with an intermediate lock mechanism, the variable valve timing mechanism varying a rotational phase of a camshaft relative to a crankshaft between a most advanced phase and a most retarded phase, and comprising a first rotary body, a second rotary body, and an intermediate lock mechanism, the first rotary body rotating synchronously with one of the crankshaft and the camshaft, the second rotary body rotating synchronously with the other one of the crankshaft and the camshaft, having a coaxial axis with the first rotary body, and accommodating the first rotary body in a relatively rotatable manner, the second rotary body being formed by fastening a first member and a second member to each other, and the intermediate lock mechanism locking rotation of the first rotary body relative to the second rotary body at an intermediate lock phase between the most advanced phase and the most retarded phase, wherein the intermediate lock mechanism includes:

a first lock pin and a second lock pin that are arranged in the first rotary body, the first and second lock pins being projectable and retractable independently from each other;

an advancement restricting groove arranged in the first member, the advancement restricting groove being formed in such a manner as to, when the first lock pin is projected, become engaged with the first lock pin to lock, at the intermediate lock phase, rotation of the first rotary body to an advancing side and permit, at the intermediate lock phase, rotation of the first rotary body to a retarding side; and a retardation restricting groove arranged in the second member, the retardation restricting groove being formed in such a manner as to, when the second lock pin is projected, become engaged with the second lock pin to lock, at the intermediate lock phase, rotation of the first rotary body to the retarding side and permit, at the intermediate lock phase, rotation of the first rotary body to the advancing side, wherein when the advancement restricting groove engages with the first lock pin to lock, at the intermediate lock phase, rotation of the first rotary body to the advancing side, the retardation restricting groove engages with the second lock pin to lock, at the intermediate lock phase, rotation of the first rotary body to the retarding side.

2. The variable valve timing mechanism with an intermediate lock mechanism according to claim 1, wherein a ratchet groove having a comparatively small depth is formed continuously from each of the advancement restricting groove and the retardation restricting groove.

3. The variable valve timing mechanism with an intermediate lock mechanism according to claim 1, wherein one of the first and second members is a cam sprocket and the other is a cover that is formed to cover a front surface of the cam sprocket.

4. A method for manufacturing a variable valve timing mechanism with an intermediate lock mechanism, the variable valve timing mechanism varying a rotational phase of a camshaft relative to a crankshaft between a most advanced phase and a most retarded phase, and comprising a first rotary body, a second rotary body, and an intermediate lock mechanism, the first rotary body rotating synchronously with one of the crankshaft and the camshaft, the second rotary body rotating synchronously with the other one of the crankshaft and the camshaft, having a coaxial axis with the first rotary body, and accommodating the first rotary body in a relatively rotatable manner, the second rotary body being formed by fastening a first member and a second member to each other, and the intermediate lock mechanism locking rotation of the first rotary body relative to the second rotary body at an intermediate lock phase between the most advanced phase and the most retarded phase, the method for manufacturing a variable valve timing mechanism with an intermediate lock mechanism comprising:

assembling a first lock pin and a second lock pin to the first rotary body;

forming an advancement restricting groove in the first member, the advancement restricting groove becoming engaged with the first lock pin to lock, at the intermediate lock phase, rotation of the first rotary body to an advancing side and permit, at the intermediate lock phase, rotation of the first rotary body to a retarding side;

forming a retardation restricting groove in the second member, the retardation restricting groove becoming engaged with the second lock pin to lock, at the intermediate lock phase, rotation of the first rotary body to the retarding side and permit, at the intermediate lock phase, rotation of the first rotary body to the advancing side; and fastening the first member and the second member to each other with the first lock pin held in contact with an end of the advancement restricting groove at the advancing side and the second lock pin held in contact with an end of the retardation restricting groove at the retarding side.

5. The method for manufacturing an variable valve timing mechanism with an intermediate lock mechanism according to claim 4, wherein a ratchet groove having a comparatively small depth is formed continuously from each of the advancement restricting groove and the retardation restricting groove.

* * * * *